United States Patent [19]

Southam

[11] 4,224,055

[45] Sep. 23, 1980

[54] PROCESS FOR THE PRODUCTION OF ALUMINIUM

[75] Inventor: Frederick W. Southam, Kingston, Canada

[73] Assignee: Alcan Research and Development Limited, Montreal, Canada

[21] Appl. No.: 962,652

[22] Filed: Nov. 21, 1978

[30] Foreign Application Priority Data

Nov. 28, 1977 [GB] United Kingdom ..... 49446/77

[51] Int. Cl.[2] ..... C22D 7/02

[52] U.S. Cl. ..... 75/10 R; 75/68 A

[58] Field of Search ..... 75/68 R, 68 A, 10 R, 75/46

[56] References Cited

U.S. PATENT DOCUMENTS

| | | | |
|---|---|---|---|
| 3,734,717 | 5/1973 | Seglin et al. | 75/46 |
| 4,099,959 | 7/1978 | Dewing et al. | 75/68 A |

*Primary Examiner*—M. J. Andrews

*Attorney, Agent, or Firm*—Cooper, Dunham, Clark, Griffin & Moran

[57] ABSTRACT

A process for the production of aluminium in two steps:

$$2Al_2O_3+9C=Al_4C_3+6CO \quad \text{(ii)}$$

and $$Al_4C_3+Al_2O_3=6Al+3CO \quad \text{(iii)}$$

Reaction (ii) takes place in a materials addition chamber and reaction (iii) in a high temperature chamber. Slag is circulated between the chambers via conduits and electrical resistance heating is carried out in the conduits. Heating is controlled by differential control of the resistance of the slag in the conduits by the application of gas to at least one of the conduits.

3 Claims, 4 Drawing Figures

PROCESS FOR THE PRODUCTION OF ALUMINIUM

The present invention relates to the production of aluminium by the direct reduction of alumina by carbon.

The direct carbothermic reduction of alumina has been described in the U.S. Pat. Nos. 2,829,961 and 2,974,032, and furthermore the scientific principles involved in the chemistry and thermodynamics of the process are very well understood.

It has long been recognised (U.S. Pat. No. 2,829,961) that the overall reaction involved in the carbothermic reduction of alumina $$Al_2O_3+3C=2Al+3CO \quad \text{(i)}$$

takes place, or can be made to take place, in two steps:

$$2Al_2O_3+9C=Al_4C_3+6CO \quad \text{(ii)}$$

and $$Al_4C_3+Al_2O_3=6Al+3CO \quad \text{(iii)}$$

Both reactions are highly endothermic but the reaction (ii) which leads to the formation of $Al_4C_3$ can be seen , from the available thermodynamic data, to proceed at an appreciably lower temperature than the reaction (iii), which leads to conversion of aluminium carbide to aluminium. Due to the lower temperature and lower thermodynamic activity of aluminium at which reaction (ii) may take place, the concentration of fume (in the form of gaseous Al and gaseous $Al_2O$) carried off by the gas from reaction (ii) when carried out at a temperature appropriate to that reaction is much lower than that carried in the gas at a temperature appropriate to reaction (iii); furthermore, the volume of CO from reaction (iii) is only half that from reaction (ii).

Existing data suggests that the energy required for each of the two stages is of the same order of magnitude.

We have already described in U.S. Pat. No. 4,099,959 a process for the production of aluminium metal by the carbothermic reduction of alumina which relies on establishing a circulating stream of molten alumina slag, containing combined carbon, in the form of aluminium carbide or oxycarbide; circulating the stream of molten alumina slag through a low temperature zone (maintained at least in part at a temperature at or above that required for reaction (ii), but below that required for reaction (iii)) and introducing carbon in this zone; forwarding the stream of molten alumina, now enriched in $Al_4C_3$ as a result of reaction (ii), to a high temperature zone (maintained at least in part at a temperature at or above a temperature required for reaction (iii)); collecting and removing aluminium metal liberated at said high temperature zone as a result of reaction (iii), the molten alumina slag from the high temperature zone then being forwarded to the same or subsequent low temperature zone. The introduction of alumina to make up the alumina consumed in the process is preferably effected at the high temperature zone.

The product aluminium and at least a major part of the gas evolved in reaction (iii) are preferably separated from the molten slag by gravitational action by allowing them to rise through the molten slag in the high temperature zone so that the product aluminium collects as a supernatant layer on the slag and the evolved gas blows off to a gas exit passage leading to apparatus for fume removal.

The process as described in U.S. Pat. No. 4,099,959 is primarily envisaged as depending upon the introduction of the necessary energy into the system by electrical resistance heating. Current was passed through the stream of molten slag in transit from the low temperature zone and during at least part of its path through the high temperature zone.

The requirements for introduction of heat energy into the system are three-fold (a) to support reaction (ii), (b) to support reaction (iii) and (c) to make up heat lossess. The heat requirement (a) may be provided by the sensible heat of the slag as it enters the low temperature zone.

One form of apparatus for carrying out the process included one or more materials addition chambers where reaction (ii) occurred at a relatively low temperature and one or more high temperature chambers for removal of product aluminium and gas evolved in reaction (iii), each materials addition chamber being connected to the succeeding high temperature chamber by a forward connecting conduit which led into the high temperature chamber through an upwardly directed portion. Each high temperature chamber led into a succeeding materials addition chamber by a return conduit. Heat input to the system was achieved by electrical resistance heating of the slag and the system was arranged so that current was passed through the slag both in the forward conduit or conduits and in the return conduit or conduits. The system was arranged to ensure that the heat released in the forward conduit or conduits was sufficient to cause reaction (iii) to take place in an upwardly directed portion of the conduit with the result that the gas released in this part of the system acted as a gas lift pump to propel the stream of slag around the system.

In the described arrangement current was also passed through the slag in the return conduit or conduits.

Where the system included only a single materials addition chamber and high temperature chamber the forward conduit and return conduit formed parallel electrical connections between the two chambers. In a multi-chamber system each forward conduit was connected electrically in series with the return conduit leading from the related high temperature chamber to the next materials addition chamber.

It will be apparent that with either form of system the distribution of heat energy between a forward conduit and its related return conduit will depend upon the electrical resistances of the slag stream in such conduits. Since there is no means of controlling the electrical resistances of the slag in the conduits without change of other operating parameters and, conversely, since change of other operating parameters, particularly applied voltage, lead to changes in the ratio of the electrical resistances of the slag in the conduits, there is some lack of control in the system. In particular it is not possible to regulate accurately the release of heat energy in the return conduit or conduits and this could lead to difficulty in maintaining the stability of the frozen alumina lining in the reverse conduit.

It is an object of this invention to provide an improvement in the process which allows the distribution of electrical current between each forward conduit and its related return conduit to be controlled independently of other operating parameters. This is achieved in accordance with the present invention by employing a pressurised external gas supply to regulate the electrical resistance of the stream of slag passing through one or both of the conduits of each pair of conduits. Thus in the existing system the external gas supply may be introduced via one or more conduits leading into either the forward conduit from the materials addition chamber to the high temperature chamber or into the return conduit leading to the succeeding materials addition chamber.

Thus in one mode of performing the invention a stream of gas bubbles from an external gas supply may be introduced at one or more positions in the return conduit and/or the forward conduit. The passage of the gas bubbles through the slag, in particular through the slag in the return conduit, has a material effect on the electrical resistance of the slag in the conduit. The effect of gas bubbles from an external source on the electrical resistance of the slag in the forward conduit is less marked because the continuity of the slag stream in the forward conduit is already disturbed by the gas bubbles generated therein as a result of reaction (iii).

In another arrangement the return conduit is in the form of an inverted U-tube. Control of the electrical resistance of slag in the conduit may be achieved by introducing gas under pressure at the apex. This will lead to an effective restriction on the cross section of the slag stream in this region, dependent upon the volume of gas introduced. By increase of the space occupied by gas in the inverted U-tube conduit a large and controllable increase in the electrical resistance of the slag in the return conduit may be achieved with consequent change in the current distribution between the forward conduit and its related return conduit. Decrease of the volume of gas in the inverted U-tube will, of course, lead to reduction in electrical resistance. In order to counterbalance the effects on increase or decrease of electrical resistance in the forward and/or return conduits by employing the method of the invention, it may be desirable to provide independent heating systems in the high temperature chamber and/or the materials addition chamber in order to provide supplemental heating to balance the system. This could be achieved by providing a pair of spaced electrodes in such chamber with preferably some restriction in the current path between them, to provide a local electrical resistance. Alternatively, supplemental heat might be provided in one or both chambers by the use of plasma guns.

Referring now to the accompanying drawings.

Figure 1:
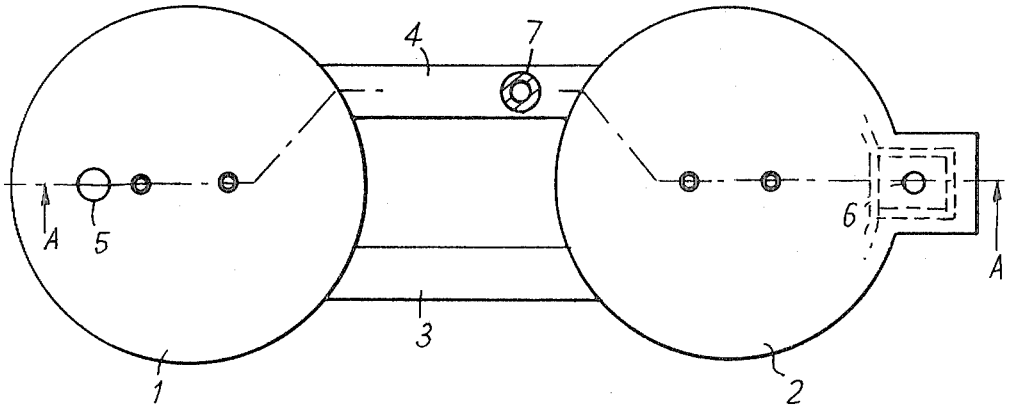
FIG. 1 is a diagrammatic plan view of one form of apparatus for carrying out the invention.
Figure 2:
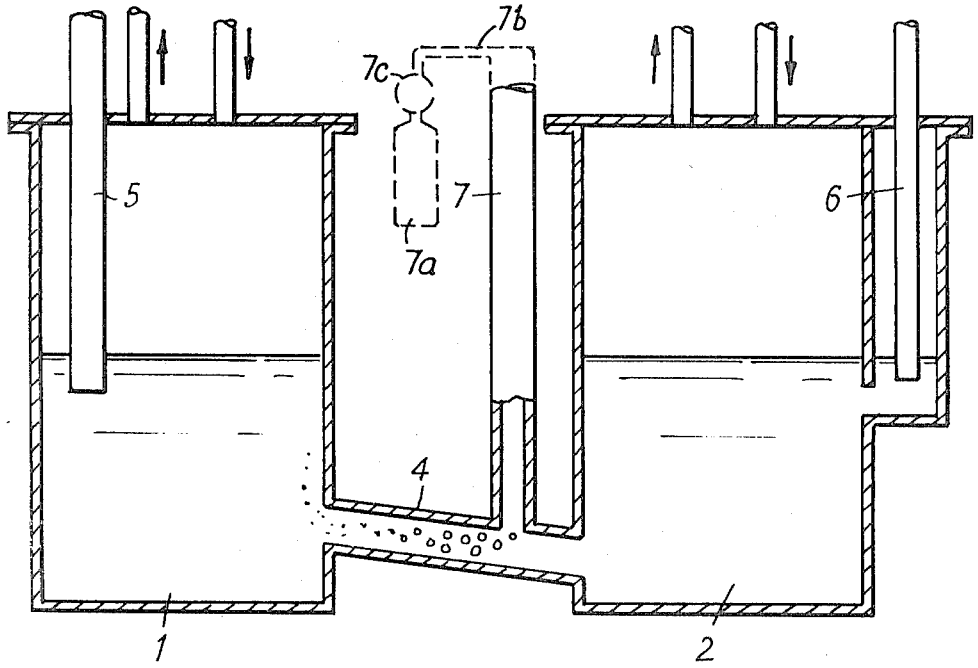
FIG. 2 is a section on line A—A of FIG. 1.

In the apparatus of FIGS. 1 and 2 the molten alumina slag is circulated through a system comprising a materials addition chamber 1 and a high temperature chamber 2, connected to each other by a forward conduit 3 and a return conduit 4. Both the forward conduit 3 and return conduit 4 lead upwardly in the direction of slag flow.

Chambers 1 and 2 are provided with electodes 5 and 6 for effecting electric resistance heating and there are also ducts (not shown) for the introduction of carbon feed and for leading away the evolved carbon monoxide in chamber 1. The chamber 2 is also provided with ducts (not shown) to exhaust evolved gas and also with one or more tap holes to remove the product in the form of Al, saturated with $Al_4C_3$, which separates as a supernatant layer in the chamber 2. Make-up alumina feed is supplied through a separate duct at some point or points in the system, preferably in chamber 2.

The system is designed so that the electrical resistance offered by the reurn conduit 4 is considerably greater than that of the forward conduit 3. In consequence the major current flow between electrodes 5 and 6 is through the slag in conduit 3.

Without the control provided by the present invention there is little effective control that can be exercised on the distribution of current between conduits 3 and 4 and in consequence on the release of heat energy in such conduits. The containment of the slag in the system is achieved by maintaining a layer of frozen slag at the walls of the conduits 3 and 4 by external cooling. Without the ability to change the effective resistance of the slag in at least one of the conduits any change in the voltage applied between electrodes 5 and 6 to change the total system current will be accompanied by a slow and probably uneven change in the thickness of the frozen alumina in the two conduits with a consequent shift in the distribution of current between the two conduits.

To counteract possible changes in the electrical resistance of conduits 3 and 4, in accordance with the present invention there is provided a refractory tube 7, which communicates with a port in return conduit 4. Gas may be supplied through tube 7 from a gas supply 7*a* via a coupling 7*b* which has a control valve 7*c*. The gas is thus supplied at a controllably variable rate to decrease the volume of slag in conduit 4 with consequent increase in electrical resistance of the conduit. Appropriate adjustment of the rate of gas flow in this conduit may be used to change the electrical resistance in this region by increasing or decreasing the volume of slag in the conduit.

The ability to increase the electrical resistance of the slag in conduit 4 also has the advantage that the occurrence of reaction (iii) in the return conduit 4 can be controlled or avoided, as desired.

The system of FIGS. 1 and 2 suffers from the practical disadvantage that it may be necessary to maintain a continuous slow flow of gas through tube 7 to avoid the port in conduit 4 becoming blocked with frozen slag.

Figure 3:
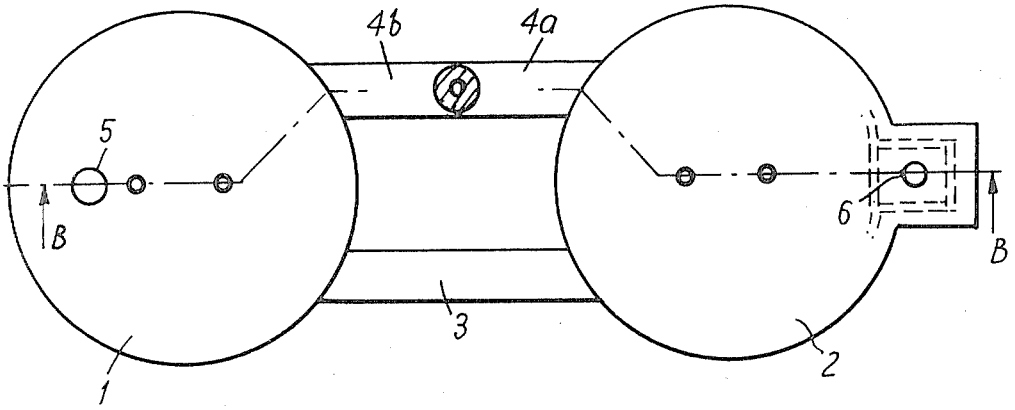
FIG. 3 is a diagrammatic plan view of another form of apparatus.
Figure 4:
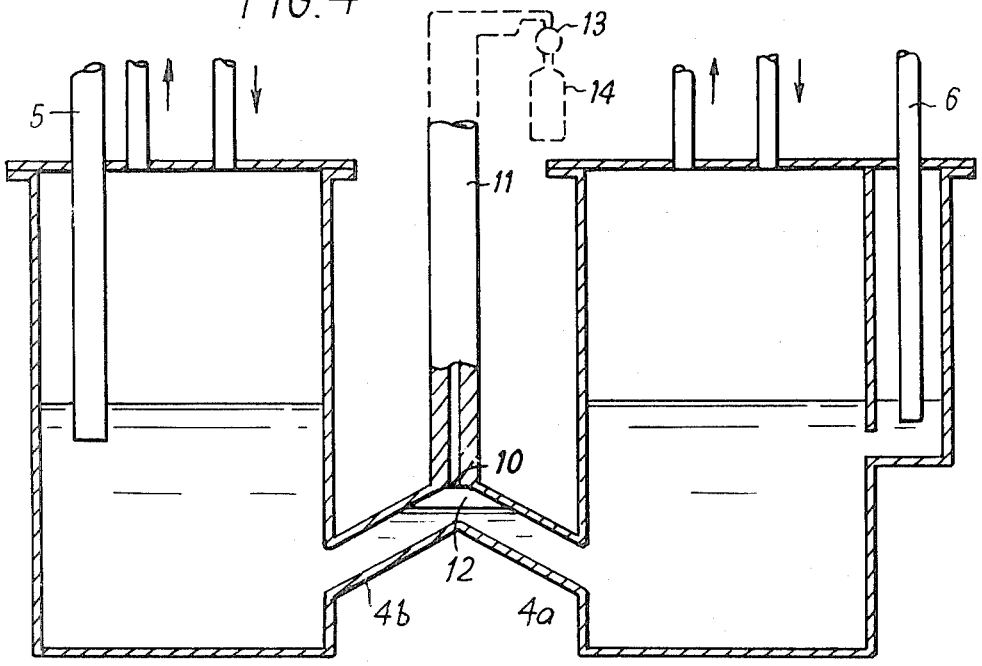
FIG. 4 is a section on line B—B of FIG. 3.

In order to overcome this difficulty the modified system of FIGS. 3 and 4 allows the electrical resistance of the return conduit to be controlled by means of an external gas supply without any flow of externally applied gas through the slag. This has the advantage of avoiding extra carry-over of fumes in chamber 1, arising from the additional gas flow. The system is more sensitive in allowing a wider variation of electrical resistance to be achieved than in the system of FIGS. 1 and 2 (bearing in mind the probable practical necessity of maintaining a continuous gas flow).

In the system of FIGS. 3 and 4 the return conduit 4 is formed to provide two legs 4*a* and 4*b* which are downwardly directed, by reference to gas entry port 10, connected with gas supply tube 11. This arrangement allows gas to be trapped in a gas space 12 at the junction of the legs 4*a* and 4*b*. Increase or decrease of the volume of gas in the gas space 12 respectively increases or decreases the electrical resistance of the return conduit 4. Control of the gas pressure in space 12 is achieved by operation of a valve 13 in a coupling from a gas supply 14 to tube 11. Valve 13 allows extra gas to be admitted to space 12 or allows the space to be vented at will.

The ability to vary the electrical resistance in the return conduit 4 in relation to the electrical resistance of the forward conduit allows the heat input in the two conduits to be controlled in relation to each other and thus allows electrical stability of the system to be achieved. By exercising this control the heat input in the return conduit can be matched with the heat lossess occurring in it.

Although the regulation of the electrical resistance of the conduits has been described and illustrated with reference to a two-chamber system, the same method of control of the electrical resistance of the slag in a conduit may be applied with equal advantage in a system where there is a series of alternate materials addition chambers and high temperature chambers connected in a closed loop by alternate forward and return conduits.

The gas employed in the process of the present invention for regulation of current distribution should be substantially inert in relation to the alumina slag at the locality where it is introduced. The preferred gas for the present purpose is carbon monoxide. Hydrogen and argon are other examples of suitable gases.

I claim:

1. A process for the production of aluminium metal consisting in circulating molten alumina slag between one or more materials addition chambers where reaction of alumina with carbon to form aluminium carbide (reaction (ii)) occurs at a relatively low temperature and one or more high temperature chambers for removal of product aluminium and gas evolved in reaction of aluminium carbide with alumina to release Al metal (reaction (iii)), each materials addition chamber being connected to the succeeding high temperature chamber by a forward connecting conduit which leads into the high temperature chamber through an upwardly directed portion, each high temperature chamber leading into a succeeding materials addition chamber by a return conduit; applying electrical resistance heating of the slag in the forward and return conduits; and adjusting the resistance of the slag in at least one of the conduits by the application of pressurised gas thereto from an external supply, said gas being substantially inert in relation to the alumina slag at the locality where it is introduced.

2. A process as claimed in claim 1 wherein the pressurised gas is bubbled into the slag to increase its resistivity.

3. A process as claimed in claim 1 wherein the conduit to which gas is applied is of an inverted U shape and the gas is applied at the apex of the conduit to depress the level of slag at the U-bend.

* * * * *